US010458600B2

(12) United States Patent
Attarzadeh et al.

(10) Patent No.: US 10,458,600 B2
(45) Date of Patent: Oct. 29, 2019

(54) SYSTEM WITH REMOTELY CONTROLLED, PRESSURE ACTUATED TANK VALVE

(71) Applicant: Hexagon Technology AS, Alesund (NO)

(72) Inventors: Navid Attarzadeh, Lincoln, NE (US); Troy Marker, Seward, NE (US); Don Baldwin, Lincoln, NE (US)

(73) Assignee: Hexagon Technology AS, Alesund (NO)

( * ) Notice: Subject to any disclaimer, the term of this patent is extended or adjusted under 35 U.S.C. 154(b) by 222 days.

(21) Appl. No.: 15/475,382

(22) Filed: Mar. 31, 2017

(65) Prior Publication Data

US 2017/0292656 A1 Oct. 12, 2017

Related U.S. Application Data

(60) Provisional application No. 62/319,918, filed on Apr. 8, 2016.

(51) Int. Cl.
*F17C 13/04* (2006.01)
*F17C 13/12* (2006.01)
(Continued)

(52) U.S. Cl.
CPC ..... *F17C 13/123* (2013.01); *F17C 7/00* (2013.01); *F17C 13/002* (2013.01);
(Continued)

(58) Field of Classification Search
CPC ..... F17C 13/123; F17C 13/002; F17C 13/04; F17C 13/025; F17C 2205/035;
(Continued)

(56) References Cited

U.S. PATENT DOCUMENTS 1,897,164 A 2/1933 Endacott
3,043,331 A 7/1962 Peters
(Continued)

FOREIGN PATENT DOCUMENTS

EP 1452794 A2 9/2004
GB 812998 A 5/1959
WO 2007124784 A1 11/2007

OTHER PUBLICATIONS

International Search Report and Written Opinion dated Jul. 25, 2017 for International Application No. PCT/US2017/025276.

*Primary Examiner* — Nicolas A Arnett
(74) *Attorney, Agent, or Firm* — Mai-Tram D. Lauer; Westman, Champlin & Koehler P.A.

(57) ABSTRACT

A pressurized tank system includes a first tank, a second tank, a manifold, a first conduit connecting the first tank to the manifold, a second conduit connecting the second tank to the manifold, a first pressure actuated valve operably connected to the second conduit, a third conduit connecting the manifold and the first pressure actuated valve, and a fourth conduit connecting the first pressure actuated valve and the second tank. The first pressure actuated valve is configured for operation by fluid pressure in the third conduit. A method includes operably connecting a first pressure actuated valve at a junction between the second conduit, a third conduit connecting to the manifold, and a fourth conduit connecting to the second tank; and automatically opening the first pressure actuated valve with the fluid in the third conduit when the fluid pressure level exceeds a threshold pressure level.

19 Claims, 3 Drawing Sheets

(51) Int. Cl.
*F17C 13/00* (2006.01)
*F17C 13/02* (2006.01)
*F17C 7/00* (2006.01)

(52) U.S. Cl.
CPC ..... *F17C 13/025* (2013.01); *F17C 13/04* (2013.01); *F17C 2205/035* (2013.01); *F17C 2205/0323* (2013.01); *F17C 2205/0326* (2013.01); *F17C 2205/0329* (2013.01); *F17C 2205/0338* (2013.01); *F17C 2205/0382* (2013.01); *F17C 2221/033* (2013.01); *F17C 2250/043* (2013.01); *F17C 2250/0439* (2013.01); *F17C 2250/0636* (2013.01); *F17C 2260/021* (2013.01); *F17C 2260/023* (2013.01); *F17C 2260/042* (2013.01); *F17C 2270/0171* (2013.01)

(58) Field of Classification Search
CPC ..... F17C 2205/0382; F17C 2205/0338; F17C 2205/0329; F17C 2205/0326; F17C 2205/0323; F17C 2250/043; F17C 2250/0636; F17C 2250/0439; F17C 2221/033; F17C 2270/0171; F17C 2260/023; F17C 2260/021; F17C 2260/042
See application file for complete search history.

(56) References Cited

U.S. PATENT DOCUMENTS

| | | | | |
|---|---|---|---|---|
| 4,139,019 | A | 2/1979 | Bresie | |
| 4,657,224 | A | 4/1987 | Lattuada | |
| 5,373,702 | A | 12/1994 | Kalet | |
| 5,454,408 | A | 10/1995 | DiBella | |
| 5,488,978 | A | 2/1996 | Kountz | |
| 5,628,349 | A | 5/1997 | Diggins | |
| 5,685,350 | A | 11/1997 | Chowdhury | |
| 5,752,552 | A | 5/1998 | Kountz | |
| 5,810,058 | A | 9/1998 | Kountz | |
| 5,884,675 | A | 3/1999 | Krasnov | |
| 6,014,995 | A | 1/2000 | Agnew | |
| 6,112,760 | A | 9/2000 | Scott | |
| 6,412,588 | B1 | 7/2002 | Scott | |
| 6,648,034 | B1 * | 11/2003 | Birtcher | B08B 9/00 137/209 |
| 6,786,245 | B1 | 9/2004 | Eichelberger | |
| 6,817,385 | B1 * | 11/2004 | Sloan | B65B 1/04 137/885 |
| 7,568,507 | B2 | 8/2009 | Farese | |
| 8,156,970 | B2 | 4/2012 | Farese | |
| 8,286,675 | B2 | 10/2012 | Farese | |
| 8,443,820 | B2 | 5/2013 | Ulrey | |
| 8,534,327 | B2 | 9/2013 | Inagi | |
| 8,752,572 | B2 | 6/2014 | Pittroff | |
| 8,770,012 | B2 | 7/2014 | Yahashi | |
| 8,899,278 | B2 | 12/2014 | Cohen | |
| 9,360,161 | B2 * | 6/2016 | Barker | F17C 5/06 |
| 9,657,901 | B2 * | 5/2017 | Barker | F17C 7/04 |
| 9,951,905 | B2 * | 4/2018 | Barker | F17C 5/06 |
| 2003/0111112 | A1 * | 6/2003 | Gill | F17C 7/00 137/255 |
| 2010/0193070 | A1 | 8/2010 | Allidieres | |
| 2014/0191499 | A1 | 7/2014 | Campbell | |
| 2014/0202585 | A1 * | 7/2014 | Barker | F17C 5/06 141/4 |
| 2014/0261864 | A1 | 9/2014 | Cohen | |
| 2014/0338370 | A1 * | 11/2014 | Barker | F17C 5/02 62/47.1 |
| 2014/0352840 | A1 | 12/2014 | Blanchet | |
| 2016/0069515 | A1 | 3/2016 | Knoche | |
| 2016/0102810 | A1 * | 4/2016 | Barker | F17C 5/06 141/4 |

* cited by examiner

SYSTEM WITH REMOTELY CONTROLLED, PRESSURE ACTUATED TANK VALVE

CROSS REFERENCE TO RELATED APPLICATION

This application claims the benefit of priority of U.S. Provisional Patent Application No. 62/319,918, filed on Apr. 8, 2016, which is fully incorporated by reference herein.

BACKGROUND

In some parts of the world that lack gas pipelines, fuel such as natural gas can be delivered in high pressure storage tanks on trucks, such as illustrated in FIG. 1. To maximize the capacity of a truck trailer, several large capacity tanks are combined with several smaller capacity tanks in an assembly. A manifold system is used to pressurize and depressurize all of these connected tanks via a common filling hose.

The connections between the tanks are designed so that in the event of a fire, the pressure in the tanks will be purged out of the tanks and into the atmosphere. In a known purging process, there is a possibility that a larger tank will backfill into a smaller tank instead of purging out to the atmosphere. To avoid this outcome, in the current state of the art, a pneumatic actuator is used in some systems, so that when the pressure in the system decreases, the actuator closes a valve to isolate the larger tanks from the smaller tanks. However, commonly used pneumatic actuators are not rated for the high pressures of the storage tanks; therefore, regulators must also be included in the system. The combination of the pneumatic actuators and the pressure regulators adds complexity and expense to the currently known systems.

SUMMARY

In one aspect, a pressurized tank system comprises a first tank, a second tank, a manifold, a first conduit connecting the first tank to the manifold, a second conduit connecting the second tank to the manifold, a first pressure actuated valve operably connected to the second conduit, a third conduit connecting the manifold and the first pressure actuated valve, and a fourth conduit connecting the first pressure actuated valve and the second tank. The first pressure actuated valve is configured for operation by fluid pressure in the third conduit.

In another aspect, a method for controlling fluid flow in a system is disclosed. The system comprises a first tank, a second tank, a manifold, a first conduit connecting the first tank to the manifold, and a second conduit connecting the second tank to the manifold. The method comprises operably connecting a first pressure actuated valve at a junction between the second conduit, a third conduit connecting to the manifold, and a fourth conduit connecting to the second tank. Moreover, the method comprises introducing fluid into the third conduit, wherein the fluid has a fluid pressure level. Additionally, the method comprises automatically opening the first pressure actuated valve with the fluid when the fluid pressure level exceeds a threshold pressure level.

This disclosure, in its various combinations, either in apparatus or method form, may also be characterized by the following listing of items:

1. A pressurized tank system comprising:
   - a first tank;
   - a second tank;
   - a manifold;
   - a first conduit connecting the first tank to the manifold;
   - a second conduit connecting the second tank to the manifold;
   - a first pressure actuated valve operably connected to the second conduit;
   - a third conduit connecting the manifold and the first pressure actuated valve, the first pressure actuated valve being configured for operation by fluid pressure in the third conduit; and
   - a fourth conduit connecting the first pressure actuated valve and the second tank.

2. The system of item 1, wherein the first tank has a larger volume than the second tank.
3. The system of any of items 1-2, further comprising a second valve operably connected to the first conduit.
4. The system of item 3, further comprising a third valve operably connected to a fifth conduit between the manifold and an atmosphere outside the system.
5. The system of any of items 1-4, further comprising a fluid source connected to the manifold.
6. The system of any of items 1-5, further comprising a fluid storage station connected to the manifold.
7. The system of any of items 1-6, wherein the first pressure actuated valve is configured for bi-directional fluid flow between the second and fourth conduits.
8. The system of any of items 1-7, wherein the first pressure actuated valve opens when a fluid pressure level in the third conduit reaches a threshold pressure level.
9. The system of item 8, wherein the threshold pressure level is between about 3,600 psi and about 4,500 psi.
10. A method for controlling fluid flow in a system comprising a first tank, a second tank, a manifold, a first conduit connecting the first tank to the manifold, and a second conduit connecting the second tank to the manifold, the method comprising:
    - operably connecting a first pressure actuated valve at a junction between the second conduit, a third conduit connecting to the manifold, and a fourth conduit connecting to the second tank;
    - introducing fluid into the third conduit, wherein the fluid has a fluid pressure level; and
    - automatically opening the first pressure actuated valve with the fluid when the fluid pressure level exceeds a threshold pressure level.
11. The method of item 10 further comprising automatically closing the first pressure actuated valve when the fluid pressure level falls below the threshold pressure level.
12. The method of any of items 10-11 wherein fluid flows through the first pressure actuated valve from the second conduit to the fourth conduit.
13. The method of any of items 10-12 wherein fluid flows through the first pressure actuated valve from the fourth conduit to the second conduit.
14. The method of any of items 10-13, wherein the threshold pressure level is between about 3,600 psi and about 4,500 psi.
15. The method of any of items 10-14, wherein the first pressure actuated valve automatically opens when:
    - the fluid pressure level in the third conduit is greater or equal to about 0.6 times a fluid pressure level in the second conduit; and
    - the fluid pressure level in the third conduit is greater or equal to about 0.6 times a fluid pressure level in the fourth conduit.
16. The method of any of items 10-15 further comprising operating a second valve connected to the first conduit.

17. The method of item 16, further comprising operating a third valve operably connected to a fifth conduit between the manifold and an atmosphere outside the system.

18. The method of item 17, further comprising connecting a fluid source to the manifold.

19. The method of any of items 17-18, further comprising connecting a fluid storage station to the manifold.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

This disclosure describes a system including a remotely operated switch or valve that actuates to isolate a tank from a bank of tanks in the event of a loss of pressure in a system, such as when a fire triggers a purging process. Other applications for a disclosed system include uses during filling or unloading of a tank or bank of tanks.

Figure 2:
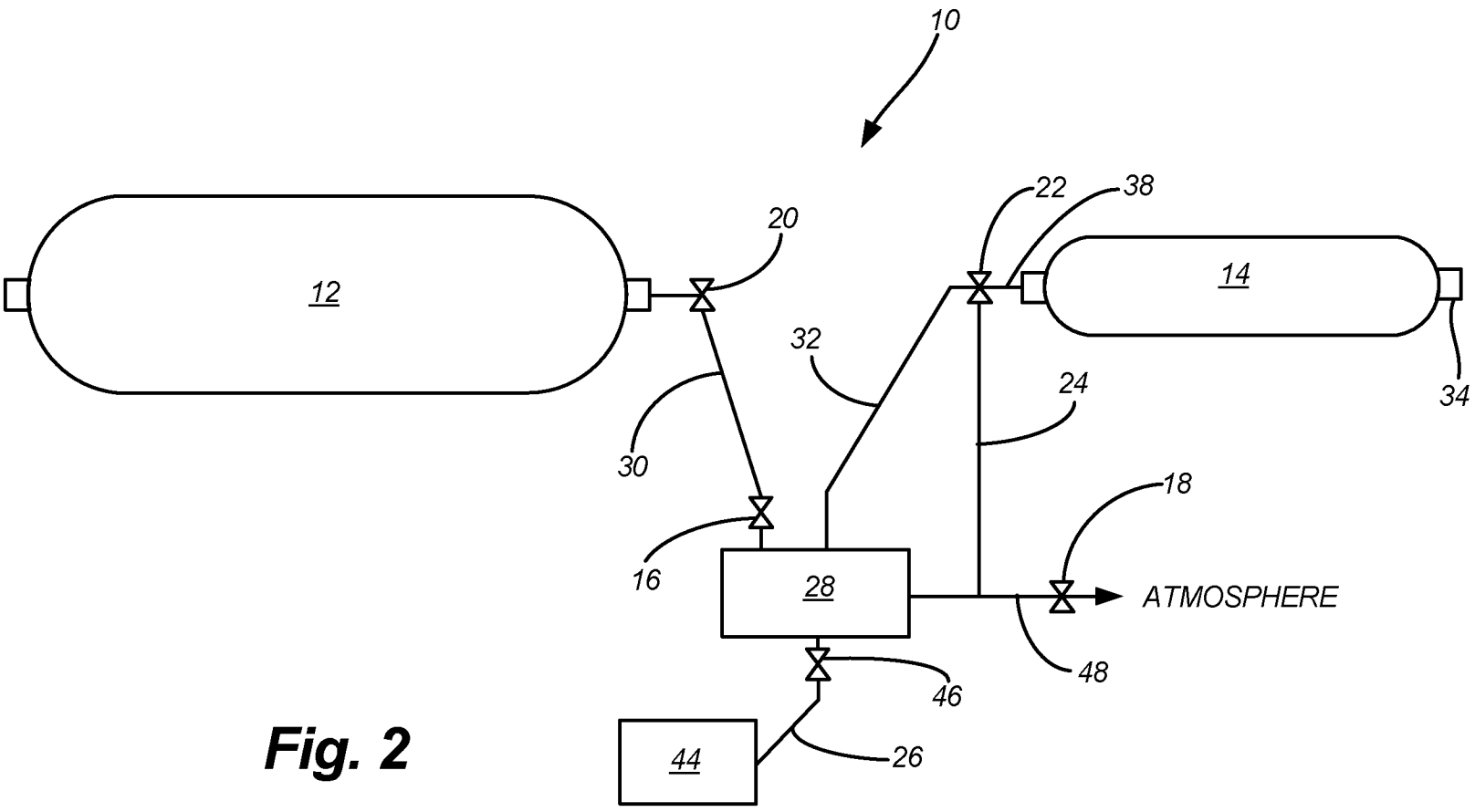
FIG. 2 is a schematic diagram of an exemplary disclosed system using a remotely controlled, pressure actuated tank valve.

FIG. 2 shows a schematic diagram of a pressurized tank system 10 in which tank 12 has a larger volume than tank 14. Valve 16, valve 18 and valve 20 are controlled by an operator, such as manually or by computer control. Pressure-actuated valve 22 automatically opens and closes in response to pressure in line 24. Because pressure-actuated valve 22 is not directly opened and closed by an operator or computer-controlled actuator, for example, it is sometimes referred to as being "remotely operated." Because an operator does not need to open and close pressure-actuated valve 22 directly, the described concept reduces manual handling in hard-to-reach areas and decreases the chance for human error.

The current disclosure uses the term "gas" to generally refer to a gaseous phase fluid under pressure. However, it is to be understood that other fluids can also be stored in system 10. Moreover, the current disclosure uses the term "tank" to generally refer to a pressure vessel, such as a composite filament wound pressure vessel. Details relevant to the formation of exemplary pressure vessels 12, 14 are disclosed in U.S. Pat. No. 4,838,971, titled "Filament Winding Process and Apparatus," which is incorporated herein by reference. However, it is to be understood that other containers may also be used.

In an exemplary process for filling tanks 12 and 14, a conduit 26 connects the manifold 28 to a gas source (shown as gas source/station 44). Manually or otherwise, valve 18 to the atmosphere is closed, and valves 16, 20 and 46 are opened. Pressurized fluid from the gas source 44 flows through manifold 28 and open valve 16, through conduit or line 30, and through open valve 20 to fill tank 12. Moreover, pressurized fluid from the gas source 44 flows through manifold 28 and conduits or lines 24 and 32 to pressure-actuated valve 22, which is initially closed. Conduit or line 24 is a dedicated line for the operation (e.g., opening and closing) of pressure-actuated valve 22 by fluid pressure in line 24; line 24 connects manifold 28 and pressure-actuated valve 22. In contrast, conduit or line 32 is a line for filling and emptying tank 14 via manifold 28.

When pressure in line 24 is sufficient at pressure-actuated valve 22, the pressure in line 24 opens pressure-actuated valve 22 so that flow through line 32 can then fill tank 14. After tanks 12 and 14 are filled, the operator closes valve 20 to tank 12. The operator opens valve 18—on conduit or line 48 connecting manifold 28 and an atmosphere outside system 10—to the atmosphere. Opening valve 18 causes flow lines 24, 30 and 32 to lose pressure. Because of the loss of pressure in line 24, the pressure in line 24 drops to a level that is insufficient for keeping pressure-actuated valve 22 open, and so pressure-actuated valve 22 of tank 14 closes. With valve 20 and pressure-actuated valve 22 closed, tanks 12 and 14 remain filled. Then, the conduit 26 can be disconnected from the gas source 44.

For depressurizing and emptying of the tanks 12 and 14, the conduit 26 in one application is between manifold 28 and a station (shown as gas source/station 44) that will store the gas for future consumption. In an exemplary method, a defueling station valve 46 along conduit 26 between the manifold 28 and the station 44 is initially closed. The operator closes valve 18 to the atmosphere and opens valves 16 and 20 allowing gas in line 30 to flow from the high pressure tank 12 and through the manifold 28 to pressurize the lines 24 and 32. The pressure in line 24 opens pressure-actuated valve 22—in a case wherein the pressure in tank 12 is greater than the pressure in tank 14 (and other conditions for opening pressure-operated valve 22 are met)—thereby allowing gas from tank 12 to flow into tank 14 through line 32. This flow ceases upon reaching a pressure equilibrium balance in tanks 12 and 14. When the defueling station valve 46 is opened along conduit 26, both tanks 12 and 14 depressurize, thereby emptying into the gas storage station 44.

In the case of a fire wherein tanks 12 and 14 are filled, a user may manually open valves 16, 18 and 20 or a sensor can automatically open valves 16, 18 and 20, for example, to cause purging of the contents of tank 12 and depressurization in lines 24, 30 and 32. The depressurization of line 24 causes pressure-actuated valve 22 to automatically close when there is insufficient pressure in line 24 to keep pressure-actuated valve 22 open. This automatic closure of pressure-actuated valve 22 therefore isolates smaller tank 14 from larger tank 12, thereby preventing backflow of pressurized gas from tank 12 to tank 14. In a case where an undesirable amount of gas remains in tank 14, tank 14 may be purged through boss 34 in a separate operation.

Figure 1:
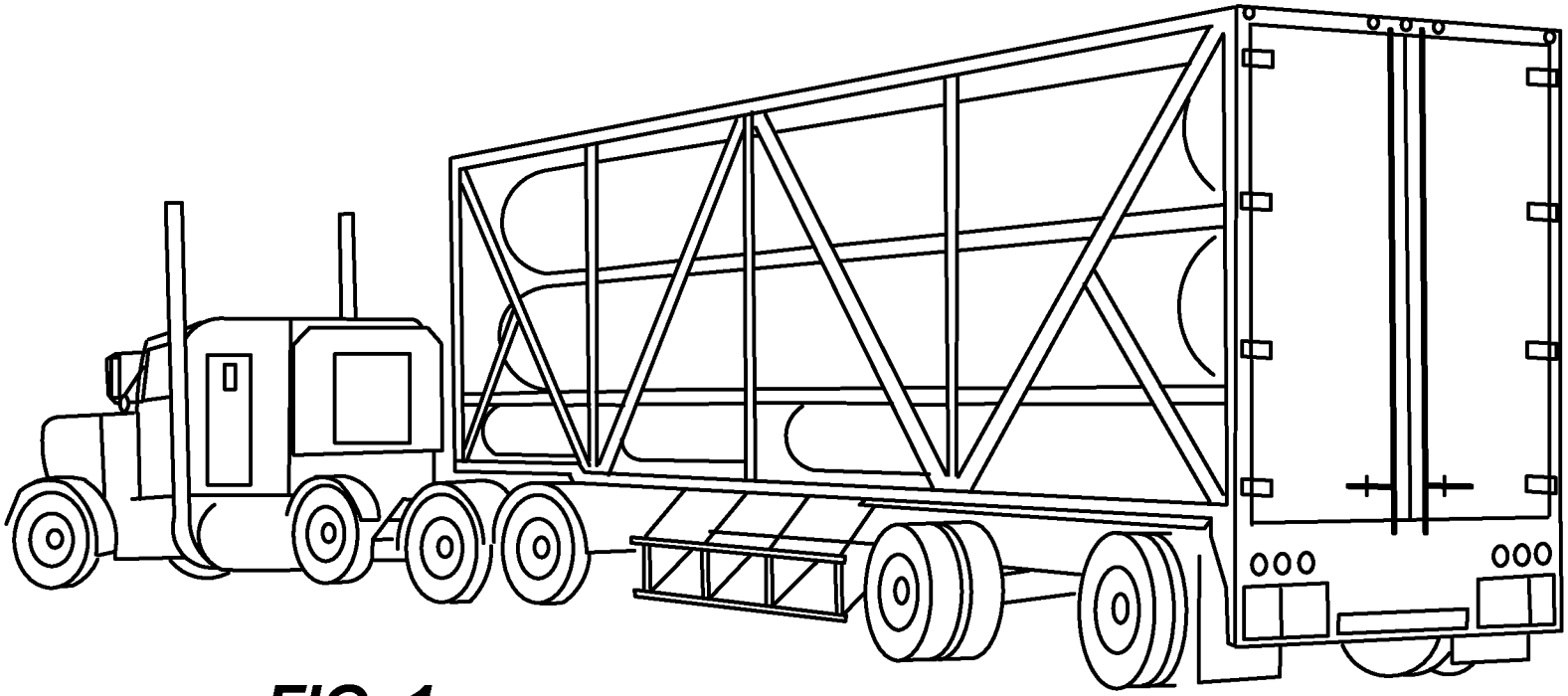
FIG. 1 (PRIOR ART)
FIG. 1 is a side perspective view of a known semi-trailer container loaded with a plurality of pressure vessels.
Figure 3:
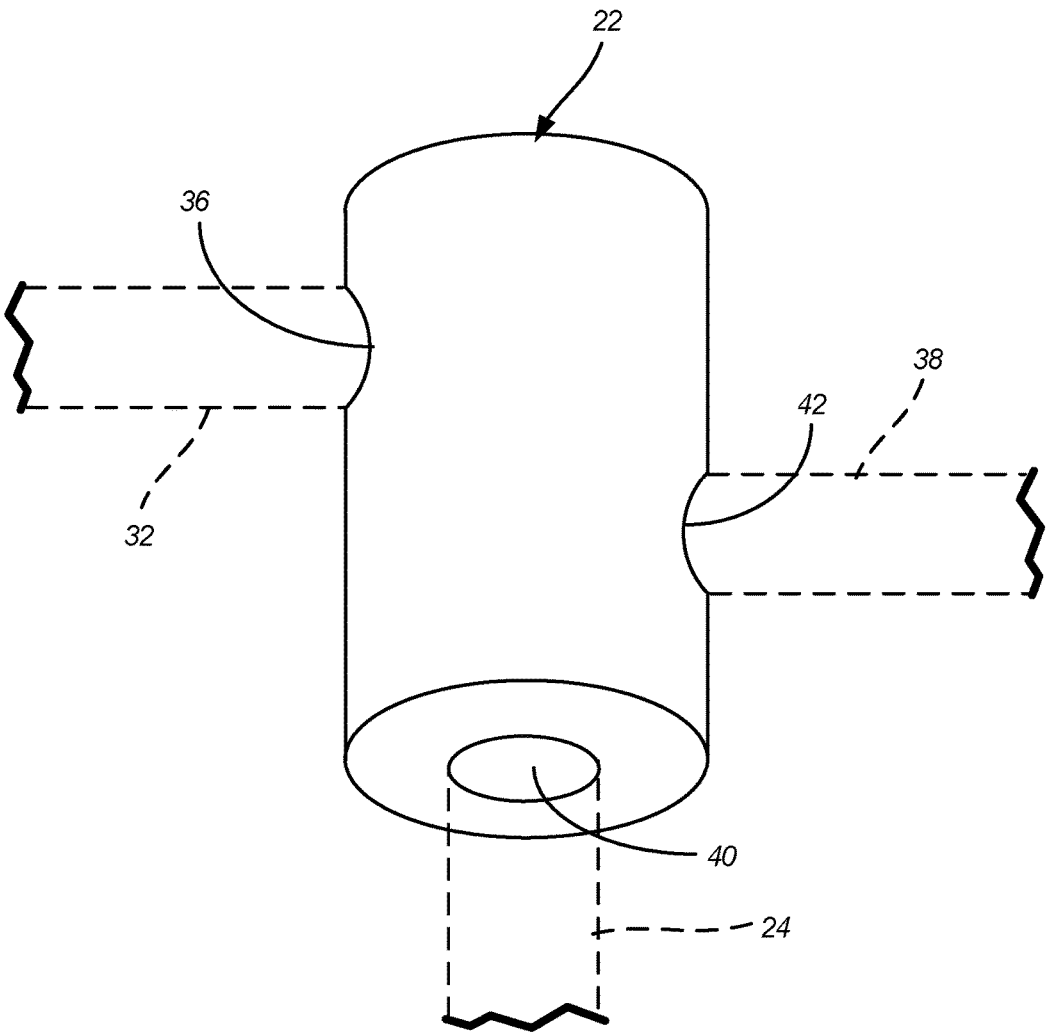
FIG. 3 is a perspective view of an exemplary embodiment of a remotely controlled, pressure actuated tank valve of the system of FIG. 2.

In an assembly of multiple tanks such as shown in FIG. 1, gas flow lines for some of the tanks may be difficult to access for opening and closing valves. Thus, the provision of a pressure-actuated valve 22 that is operated entirely by gas flow through a dedicated valve actuation pressure line 24 allows for automatic opening and closing of the pressure-actuated valve 22 in response to the pressure of gas flow in line 24. Referring to FIG. 3, such a pressure-actuated valve 22 may use a baising member (e.g., a spring) that operates in response to the pressure in line 24, to open or close port 36 in valve 22 to line 32. A suitable pressure-actuated valve 22 is commercially available as a ¾ inch, bi-directional pneumatically actuated valve, from Clark Cooper, a division of Magnatrol Valve Corp., of Roebling, N.J.

In an exemplary embodiment, pressure-actuated valve 22 is calibrated to open and close port 36 at a desired pressure value or range of pressure values of gas flow in line 24, as consistent with the filling and depressurizing methods discussed above. This pressure value or range can be much greater than the pressures that can be accommodated with conventional pneumatic actuators. For example, conventional pneumatic actuators are generally operable up to about 500 psi (pounds per square inch). Thus, the pneumatic actuators are generally used with complicated, cumbersome and expensive pressure regulators that decrease line pressures to the low range that can be used with the conventional pneumatic actuator. In contrast, pressure-actuated valve 22 can be a mechanical apparatus that is able to withstand typical pressure levels in system 10, such as up to 5,000 psi for the storage of compressed natural gas, for example. Moreover, valve 22 can operate in temperatures between about −50 degrees F. and about 180 degrees F., which is suitable for the storage of compressed natural gas, for example. While exemplary values are given for compressed natural gas, system 10 is also suitable for the storage of other fluids, including hydrogen gas, for example. For the storage of hydrogen gas, pressure-actuated valve 22 is designed or selected to withstand pressure levels up to 22,000 psi, for example, and temperatures between about −50 degrees F. and about 180 degrees F. It is contemplated that still other operation ranges of pressures and temperatures may be suitable for other fluids, such as helium, nitrogen, neon, or argon, for example.

FIG. 3 shows a view of valve 22, which is configured to be connected in system 10 at a junction of line 32, line 24, and line 38 (fluidly connecting valve 22 and tank 14 to manifold 28 and the atmosphere). Line 32 is connected to port 36 of valve 22. Line 24 is connected to port 40 of valve 22. Line 38 is connected to port 42 of valve 22. The pressure of fluid in line 32 is referred to herein as $P_{32}$. The pressure of fluid in line 24 is referred to herein as $P_{24}$. The pressure of fluid in line 38 is referred to herein as $P_{38}$. The pressure of fluid in tank 12 is referred to herein as $P_{12}$. The pressure of fluid in tank 14 is referred to herein as $P_{14}$. In many cases, $P_{12}=P_{32}$ and $P_{14}=P_{38}$. In an exemplary embodiment, valve 22 is bi-directional between port 36 and port 42, allowing fluid flow from line 32 to line 38 and vice versa. In an exemplary embodiment, valve 22 is normally closed. When $P_{24}$ reaches a threshold pressure level ($P_T$), valve 22 opens, allowing flow between lines 32 and 38. In an exemplary embodiment, $P_T$ is between about 100 psi and about 4,500 psi, for example. Even more particularly, $P_T$ can be between about 3,600 psi and about 4,500 psi. The flow direction will be determined by $P_{32}$ and $P_{38}$. When $P_{32}>P_{38}$, the fluid will flow through valve 22 from line 32 to line 38. Conversely, when $P_{32}<P_{38}$, the fluid will flow through valve 22 from line 38 to line 32. In an exemplary embodiment, $P_T$ is set so that valve 22 opens when $P_{24}\geq 0.6P_{38}$ and $P_{24}\geq 0.6P_{32}$. In an exemplary embodiment, pressure-actuated valve 22 automatically closes when $P_{24}$ falls below $P_T$. In an exemplary embodiment, valve 22 remains closed when $P_{24}\leq 0.35P_{38}$; moreover, valve 22 remains closed when $P_{24}\leq 0.45P_{32}$. While exemplary ratios of 0.35, 0.45, and 0.60 are described, it is to be understood that other ratios may also be suitable; the ratio values can be changed by changing the configuration of internal structures of the valve. These numerical relationships represent the "lag" or "dead zone" in a valve—ranges of pressures on the circuit in which behavior of the valve is not definitive. These ranges may be influenced by various factors including friction and spring forces, for example.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa. For example, while a particular embodiment of the disclosed system is shown, it is contemplated that one of valves 16 and 20 could be eliminated in a particular implementation of the disclosed system so that a single valve controls fluid communication between tank 12 and manifold 28. Moreover, in other embodiments, it is contemplated that additional valves may be added, for example to offer more control points in system 10.

What is claimed is:

1. A pressurized tank system comprising:

a first tank;

a second tank;

a manifold;

a first conduit connecting the first tank to the manifold;

a first pressure actuated valve;

a second conduit connecting the first pressure actuated valve to the manifold;

a third conduit connecting the manifold and the first pressure actuated valve, the first pressure actuated valve being configured for operation by fluid pressure in the third conduit, wherein the first pressure actuated valve is closed when the fluid pressure in the third conduct is at a first level, and wherein the first pressure actuated valve is open when the fluid pressure in the third conduct is at a second level higher than the first level; and a fourth conduit connecting the first pressure actuated valve and the second tank.

2. The system of claim 1, wherein the first tank has a larger volume than the second tank.

3. The system of claim 1, further comprising a second valve operably connected to the first conduit.

4. The system of claim 3, further comprising a third valve operably connected to a fifth conduit between the manifold and an atmosphere outside the system.

5. The system of claim 1, further comprising a fluid source connected to the manifold.

6. The system of claim 1, further comprising a fluid storage station connected to the manifold.

7. The system of claim 1, wherein the first pressure actuated valve is configured for bi-directional fluid flow between the second and fourth conduits.

8. The system of claim 1, wherein the first pressure actuated valve opens when a fluid pressure level in the third conduit reaches a threshold pressure level.

9. The system of claim 8, wherein the threshold pressure level is between about 3,600 psi and about 4,500 psi.

10. A method for controlling fluid flow in a system comprising a first tank, a second tank, a manifold, a first conduit connecting the first tank to the manifold, and a second conduit connecting a first pressure actuated valve to the manifold, the method comprising:

operably connecting the first pressure actuated valve at a junction between the second conduit, a third conduit connecting to the manifold, and a fourth conduit connecting to the second tank;

introducing fluid into the third conduit, wherein the fluid has a fluid pressure level; and automatically opening the first pressure actuated valve with the fluid when the fluid pressure level exceeds a threshold pressure level.

11. The method of claim 10 further comprising automatically closing the first pressure actuated valve when the fluid pressure level falls below the threshold pressure level.

12. The method of claim 10 wherein fluid flows through the first pressure actuated valve from the second conduit to the fourth conduit.

13. The method of claim 10 wherein fluid flows through the first pressure actuated valve from the fourth conduit to the second conduit.

14. The method of claim 10, wherein the threshold pressure level is between about 3,600 psi and about 4,500 psi.

15. The method of claim 10, wherein the first pressure actuated valve automatically opens when:

the fluid pressure level in the third conduit is greater or equal to about 0.6 times a fluid pressure level in the second conduit; and the fluid pressure level in the third conduit is greater or equal to about 0.6 times a fluid pressure level in the fourth conduit.

16. The method of claim 10 further comprising operating a second valve connected to the first conduit.

17. The method of claim 16, further comprising operating a third valve operably connected to a fifth conduit between the manifold and an atmosphere outside the system.

18. The method of claim 17, further comprising connecting a fluid source to the manifold.

19. The method of claim 17, further comprising connecting a fluid storage station to the manifold.

* * * * *